United States Patent [19]

Pham Van

[11] Patent Number: 4,514,605

[45] Date of Patent: Apr. 30, 1985

[54] COMPRESSED GAS CIRCUIT BREAKER

[75] Inventor: Doan Pham Van, Meyzieu, France

[73] Assignee: Alsthom-Atlantique, Paris, France

[21] Appl. No.: 522,369

[22] PCT Filed: Jan. 5, 1983

[86] PCT No.: PCT/FR83/00003

§ 371 Date: Jul. 29, 1983

§ 102(e) Date: Jul. 29, 1983

[30] Foreign Application Priority Data

Jan. 5, 1982 [FR] France ..... 82 00034

[51] Int. Cl.[3] ..... H01H 33/88

[52] U.S. Cl. ..... 200/148 A; 200/148 R

[58] Field of Search ..... 200/148 A, 150 G, 148 R

[56] References Cited

U.S. PATENT DOCUMENTS 4,393,291 7/1983 Stewart et al. ..... 200/148 A

FOREIGN PATENT DOCUMENTS 0035581 9/1981 European Pat. Off. ..... 200/148 A
2404721 8/1975 Fed. Rep. of Germany ... 200/148 A
2801401 2/1979 Fed. Rep. of Germany ... 200/148 A
2356258 1/1978 France ..... 200/148 A
2373141 7/1978 France ..... 200/148 A

*Primary Examiner*—Robert S. Macon
*Attorney, Agent, or Firm*—Sughrue, Mion, Zinn, Macpeak & Seas

[57] ABSTRACT

The invention provides a compressed gas circuit breaker provided both with a blast device comprising a piston (12), a cylinder (3A) and a blast orifice (10B) for sending a jet of compressed gas to the zone where an electric arc forms when the arc contacts (2,7) separate, and a volume (9) containing a gas suitable for being heated by the action of the arc, said volume including an opening (10A) to enable the hot gas to escape, characterized in that said blast orifice (10B) and said opening (10A) are disposed side by side and very close to each other.

7 Claims, 6 Drawing Figures

COMPRESSED GAS CIRCUIT BREAKER

FIELD OF THE INVENTION

The present invention relates to a circuit breaker in which the arc formed between the arc contacts at the moment of interruption is extinguished by the combined action of a thermal blast of gas internal to the circuit breaker which is raised to high temperature and pressure by the arc itself, and by a mechanical blast of gas which is compressed while the circuit breaker contacts are opening and is suddenly released.

BACKGROUND OF THE INVENTION

Such circuit breakers are known which enable currents of various magnitudes to be interrupted: the action of a mechanical blast is sufficient for small amplitude currents; the action of the thermal blast has progressively more effect with increasing amplitude of the current to be interrupted.

One aim of the present invention is to provide a gas blast circuit breaker using the mechanical and the thermal effects in which the energy required for the mechanical blast is minimal for as an effective a result as possible.

Another aim of the invention is to provide a circuit breaker in which the heat generated by the arc is diffused very quickly in the gas in order to avoid hot spots, while retaining a small gas volume in order to enable high pressure to be created.

SUMMARY OF THE INVENTION

The present invention provides a compressed gas circuit breaker provided both with a blast device comprising a piston, a cylinder and a blast orifice for sending a jet of compressed gas to the zone where an electric arc forms when the arc contacts separate, and a volume containing a gas suitable for being heated by the action of the arc, said volume including an opening to enable the hot gas to escape, said blast orifice and said opening being annular and disposed side by side, characterized in that said blast orifice is disposed at one end of an annular volume delimited by a circularly symmetrical blast nozzle and a circularly symmetrical deflector, said volume being delimited by said deflector and a first arc contact, the opening of said volume being situated next to said blast orifice, the opening of said volume and the said blast orifice being closed by a second arc contact when the circuit breaker is closed, said opening and said orifice being opened in succession by relative displacement of the arc contacts.

Advantageously the first arc contact is a ring of fingers disposed around a ring in incomplete numbers in such a manner as to leave passages between certain fingers or groups of fingers, the second arc contact being tubular.

In a variant, the first arc contact is a ring of fingers mounted on a contact support provided with orifices, the second arc contact being tubular.

In another embodiment, said blast orifice is disposed at one end of an annular volume delimited by a circularly symmetrical first arc contact and a circularly symmetrical deflector, said volume being delimited by said deflector and a circularly symmetrical insulating nozzle, said opening of said volume and said orifice being situated side by side and being closed by a second circularly symmetrical arc contact when the circuit breaker is closed, and said opening and said orifice being opened in succession by relative displacement of the arc contacts.

The invention will be well understood from the following description of several embodiments of the invention, with reference to the accompanying drawings.

DESCRIPTION OF PREFERRED EMBODIMENTS

Figure 1:
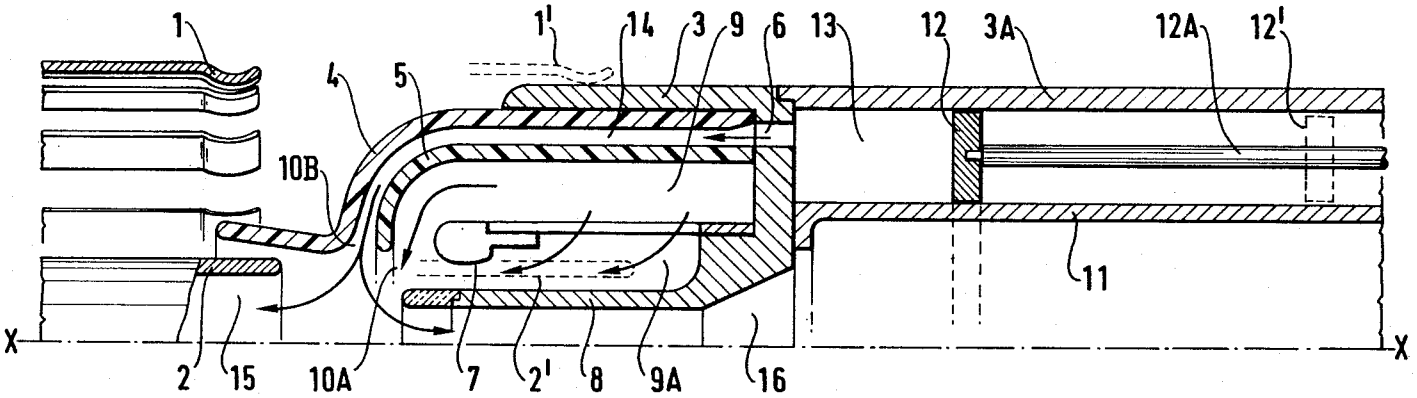
FIG. 1 is a partial half-section through a circuit breaker in accordance with a first embodiment of the invention.

FIG. 1 is a partial view in axial half-section through a circuit breaker while opening, and shows its fixed contacts and a portion of its moving equipment.

The assembly should be considered as being of circular symmetry about the axis XX.

Reference 1 designates a fixed main contact which is made of contact fingers; reference 2 designates a fixed arc contact which is tubular.

The moving equipment comprises a tubular moving main contact 3 which is fixed to a moving arc contact made of fingers 7.

The circuit breaker is shown in FIG. 1 in the course of opening. When the circuit breaker is closed, the contacts 1 and 2 co-operate with the contacts 3 and 7 respectively and occupy the positions shown in dashed lines referenced 1' and 2'.

The contact 3 has an insulating circularly symmetrical nozzle 4 inside which there is a deflector 5 which may be made of conductor or of insulator material.

The deflector 5 and the nozzle 4 define a passage of annular section.

This passage communicates via openings 6 through the contact 3 with the inside volume 13 of annular section which is defined by an extension 3A of the tubular moving contact 3, by a cylinder 11 which is coaxial with the moving contact, and by piston 12 having a rod 12A which is fixed. The position 12' of the piston 12 when the circuit breaker is closed is shown in dashed lines.

The moving contact further includes a tubular portion 8 which is on the axis side of the fingers 7 and which is coaxial with said fingers.

Figure 1A:
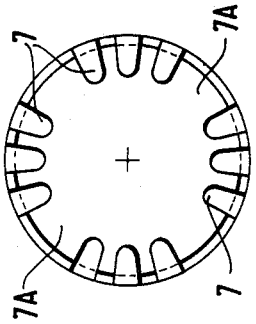
FIG. 1A is a diagram showing the disposition of the moving arc contacts.

The tubular portion extends beyond the contact fingers 7. The fixed contact 2 is engaged between the fingers and said tubular portion when the circuit breaker is closed. The fingers 7 are disposed in a ring, but in an irregular manner (see FIG. 1A) so as to leave passages 7A between pairs of fingers or groups of fingers. The role of the passages is explained below.

The volume of annular section lying between the deflector 5 and the fingers 7 is referenced 9; the annular volume lying between the fingers and the cylindrical portion 8 is referenced 9A.

The ends of the deflector 5 and the tubular portion 8 define an annular passage 10A.

The volume 14 defined by the deflector and the nozzle also opens via a ring 10B located in the immediate vicinity of the passage 10A.

The contact 2 and the tubular portion 8 define respective blast gas escape nozzles 15 and 16.

The circuit breaker operates as follows.

When the circuit breaker is closed, the relative positions of the parts is shown with the fixed parts drawn in dashed lines and the moving parts drawn in full lines.

On interruption, the relative movement of the moving part compresses the gas in a volume 13 situated to the left of the piston 12 and in the volume 14 between the nozzle and the deflector 5. The gas cannot escape since the arc contact 2 closes the outlet from the volume 14. When the arc contacts 2 and 7 separate, an arc is struck between them and then switches to between the fixed arc contact 2 and the tubular portion 8. When the contact 2 disengages the outlet from the volume 14, the gas accumulated in this volume escapes via the nozzles 15 and 16 and blasts the arc. If the current is of small amplitude the bast is sufficient to extinguish it on its first zero pass. However, if the current is of high amplitude and so long as the volumes 14 and 9 remain closed by the contact 2 and then by the pressure of the arc itself, the arc between the contacts 2 and 7 and then between the contact 2 and the tubular portion 8 is intense. It very rapidly heats the gas contained in the volume 9. The hot gases push the cooler gases situated at the end of the volume 9 and escape via the nozzles 15 and 16 once the arc contact 2 and the tubular portion 8 have separated. The pressure inside the volume 14 is high but is applied against a small cross sectional area, thereby having little slowing effect on the moving equipment.

The presence of the openings 7A enables intense gas flow. This gas mixing provides improved arc cooling and also makes it possible to avoid spots of too great a temperature which would hinder regenerating of the insulating medium.

Figure 2:
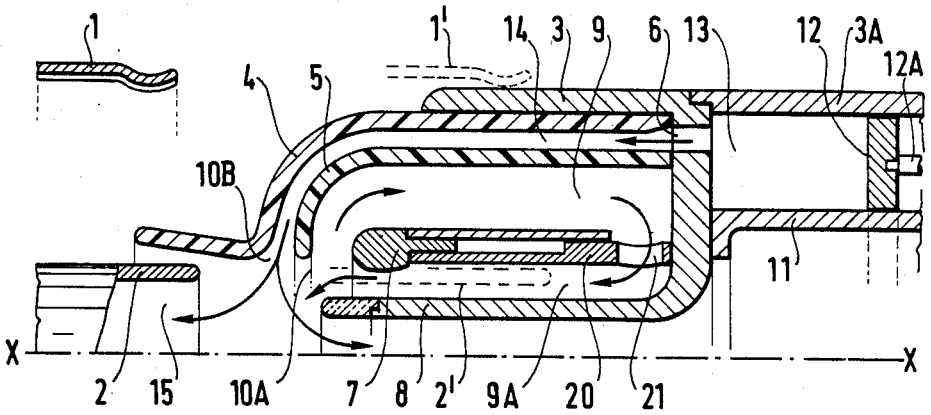
FIG. 2 is a partial half-section through a circuit breaker in accordance with a first variant embodiment.

FIG. 2 shows a variant embodiment with parts that are common to FIGS. 1 and 2 having the same reference numerals.

In this embodiment, the ring of moving arc contact fingers 7 is uninterrupted, but the finger support 20 has passages 21 in its base for the gas blast. This is useful when the number of fingers 7 does not leave a sufficient passage between the groups of fingers as is the case in FIG. 1.

Figure 3:
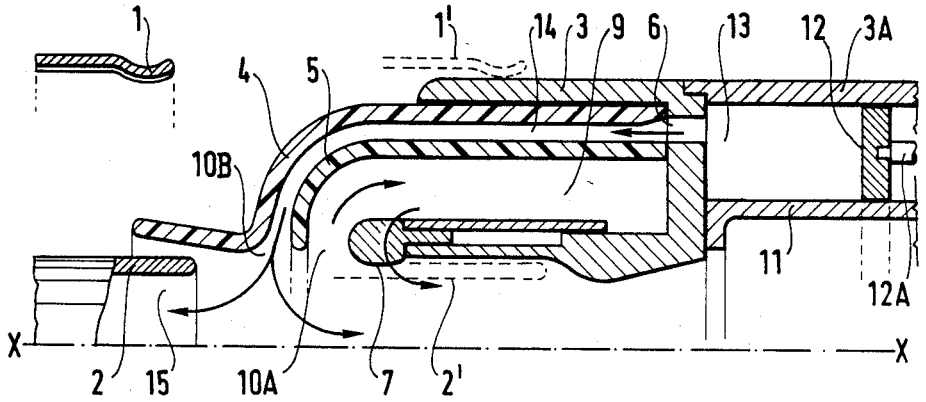
FIG. 3 is a partial half-section through a circuit breaker in accordance with a second variant embodiment.

FIG. 3 shows another variant embodiment, with the parts that are common to FIGS. 1 and 3 having the same reference numerals.

The tubular portion 8 has been omitted. The finger support 20 does not have orifices, but there are gaps between the fingers.

The gases escape from the volume 9 as soon as the fingers 7 leave the contact 2.

The passage provided for gas flow increases as the arc gets longer, thereby making the blast more regular.

Figure 4:
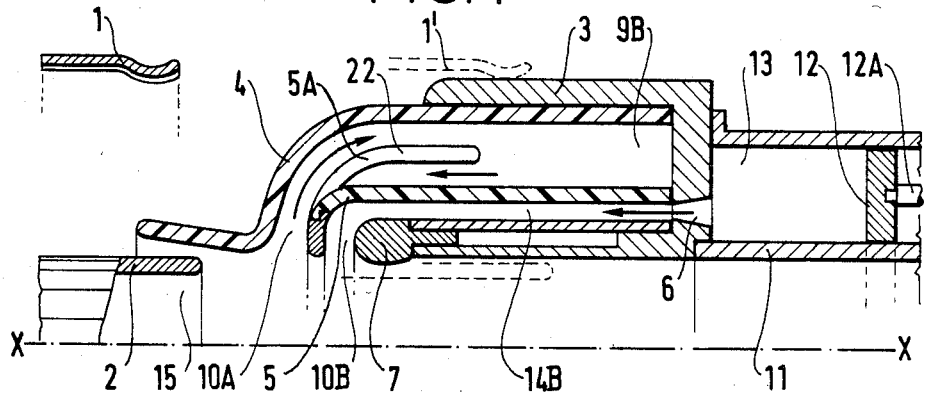
FIG. 4 is a partial half-section through a circuit breaker in accordance with a third variant embodiment.

FIG. 4 shows another variant embodiment. The parts which are common to FIGS. 1 and 4 have been given the same reference numerals.

The roles of the volumes 9 and 14 have been interchanged.

In this case the volume 9B lying between the nozzle 4 and the deflector 5 provides thermal blast, while the volume 14B between the deflector and the fingers is this time in communication with the variable volume 13.

Finally, the deflector 5 is partially made of metal and has insulating fins 22 for facilitating gas mixing.

Figure 5:
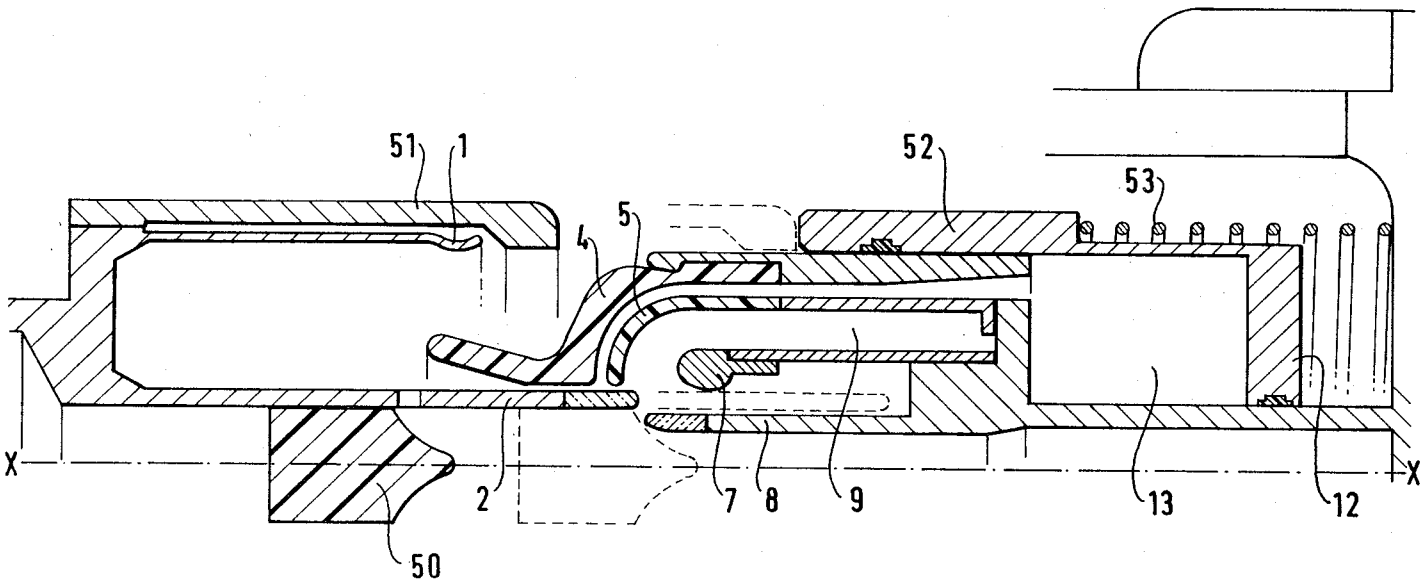
FIG. 5 is a partial half-section through a circuit breaker in accordance with a fourth variant embodiment.

In FIG. 5, the moving equipment comprises the parts 1 and 2 which are respectively the main contact and the arc contact, the insulating nozzle 4 and the insulating deflector 5. The arc contact fingers 8 are fixed. A cylinder 52 surrounds the fixed contact. It is thrust against the reaction of a spring 53 by drive means 51. A central insulating deflector 50 partially closes the passage on the inside. The gas blast during opening is obtained by the spring 53 expanding, thereby compressing the gas contained in 13 between the cylinder 52 and the end 12 of said cylinder. This mode of operation enables the energy used for the opening operation to be reduced.

Circuit breakers in accordance with the various described embodiments provide efficient arc blasting, regardless of the intensity of the current to be interrupted. This is because of the proximity of the blast zone due to the thermal effect and the blast zone due to the gas which is mechanically driven to the arc by the piston (pneumatic blast).

When the current to be interrupted is small, the pneumatic blast operates when the distance between the arc contacts is optimal and the pressure is at its highest.

When the current to be interrupted is high, there is immediate pressurization of the gas due to the arc heating the gas in the volume 9.

In practice, pneumatic blast is used only for small currents. The small blast cross section (relative to the cross section of an all-pneumatic circuit breaker) is such that the blast energy is low and the back-pressure, in the event of a high current being interrupted, does not appreciably slow down the moving equipment.

The deflector and the disposition of the arc fingers are such that there is energetic mixing of the hot gases with the less hot gases, which cools the arc more efficiently, even though the volume 9 remains fairly small. The smaller the volume 9, the higher the instantaneous pressure, but the volume must not be too small if sufficient blast is desired to extinguish the arc. Further, it is advantageous for the heat to diffuse as quickly as possible to avoid hot spots which would hinder regeneration of the insulating medium (sulphur hexafluoride)—the deflector 5 is insulative, but it may alternatively be metal so as to play a part in spreading out the electric field more evenly (FIGS. 1 to 3). However, in such a case, it should be made of a material which is a poor conductor, e.g. stainless steel, since if it were a very good conductor, the arc would take place between the contact 2 and the deflector 5 itself, and the volume 9 would not be heated effectively. It is essential for the arc to remain between the contact 2 and the tubular portion 8 which may possibly bear against the deflector.

I claim:

1. In a compressed gas circuit breaker including a first fixed arc contact (2), a second moving arc contact (7), said breaker being provided both with a blast device comprising a piston (12), a cylinder (3A) and means defining a blast orifice (10B) for sending a jet of compressed gas to the zone where an electric arc forms when the arc contacts (2, 7) separate, and means defining a volume (9) containing a gas suitable for being heated by the action of the arc, said means defining said volume including an opening (10A) to enable the hot gas to escape, said means defining said blast orifice (10B) and said opening (10A) being annular and disposed side by side, the improvement wherein said blast orifice (10B) is disposed at one end of an annular volume (4) delimited by a circularly symmetrical blast nozzle (14) and a circularly symmetrical deflector (5), said volume (9) being delimited by said deflector (5) and said second arc contact (7), and the opening (10A) of said volume being situated next to said blast orifice (10B), and said opening and said blast orifice being positioned relative to said first and second arc contacts, such that the opening (10A) of said volume and said blast orifice (10B) are closed by said first arc contact (2) when the circuit breaker is closed, and said opening (10A) and said orifice (10B) are opened in succession by relative displacement of the arc contacts (2, 7).

2. A circuit breaker according to claim 1, wherein the first arc contact (7) is an incomplete ring of fingers disposed around a ring in such a manner as to leave passages (7A) between certain fingers or groups of fingers, and the second arc (2) contact is tubular.

3. A circuit breaker according to claim 2, wherein the first arc contact (7) is a ring of fingers mounted on a contact support (20) provided with orifices (21), and, the second arc contact (2) is tubular.

4. In a compressed gas circuit breaker including a first, fixed arc contact (2), a second movable arc contact (7), said breaker being provided both with a blast device comprising a piston (12), a cylinder (3A) and means defining a blast orifice (10B) for sending a jet of compressed gas to the zone where an electric arc forms when the arc contacts (2, 7) separate, and means defining a volume (9B) containing a gas suitable for being heated by the action of the arc, said volume defining means including an opening (10A) to enable the hot gas to escape, said blast orifice (10B) and said opening (10A) being annular and disposed side by side, the improvement wherein said blast orifice (10B) is disposed at one end of an annular volume (14B) delimited by said circularly symmetrical second arc contact (7) and a circularly symmetrical deflector (5), said volume (9B) being delimited by said deflector (5) and a circularly symmetrical insulating nozzle (4), said opening (10A) of said volume and said orifice (10B) being situated side by side, and said opening and said blast orifice being positioned relative to said first and second arc contacts such that they are closed by said first circularly symmetrical arc contact (2) when the circuit breaker is closed, and said opening and said orifice are opened in succession by relative displacement of the arc contacts (2, 7).

5. A circuit breaker according to claim 4, wherein the deflector is partially made of metal and includes fins (22) made of insulating material.

6. A circuit breaker according to claim 2, wherein a tubular portion (8) of a diameter smaller than that of the second arc contact (2) is disposed co-axially with the first arc contact (7) in such a manner as to define therewith an annular volume (9A) which extends to the level of the blast opening (10A).

7. A circuit breaker according to claim 3, wherein a tubular portion (8) of a diameter smaller than that of the second arc contact (2) is disposed co-axially with the first arc contact (7) in such a manner as to define therewith an annular volume (9A) which extends to the level of the blast opening (10A).

* * * * *